US011776783B2

(12) United States Patent
Gutmann et al.

(10) Patent No.: US 11,776,783 B2
(45) Date of Patent: Oct. 3, 2023

(54) KIT AND METHOD FOR THE ASSEMBLY OF AT LEAST TWO VARIANTS OF A RELAY AND CONTACT SPRING FOR A RELAY

(71) Applicant: Tyco Electronics Austria GmbH, Vienna (AT)

(72) Inventors: Markus Gutmann, Niedernondorf (AT); Philipp Harrer, Karlstein an der Thaya (AT)

(73) Assignee: Tyco Electronics Austria GmbH, Vienna (AT)

( * ) Notice: Subject to any disclaimer, the term of this patent is extended or adjusted under 35 U.S.C. 154(b) by 272 days.

(21) Appl. No.: 16/653,023

(22) Filed: Oct. 15, 2019

(65) Prior Publication Data

US 2020/0118779 A1 Apr. 16, 2020

(30) Foreign Application Priority Data

Oct. 15, 2018 (EP) ..... 18200458

(51) Int. Cl.

| | |
|---|---|
| ***H01H 3/00*** | (2006.01) |
| ***H01H 50/56*** | (2006.01) |
| ***H01H 50/02*** | (2006.01) |
| *H01H 47/22* | (2006.01) |
| *H01H 50/44* | (2006.01) |

(52) U.S. Cl.
CPC ..... *H01H 50/56* (2013.01); *H01H 50/02* (2013.01); *H01H 47/22* (2013.01); *H01H 50/44* (2013.01)

(58) Field of Classification Search
CPC ..... H01H 50/56; H01H 50/02; H01H 47/22; H01H 50/44; H01H 50/041; H01H 11/0006; H01H 1/50
USPC ..... 335/192
See application file for complete search history.

(56) References Cited

U.S. PATENT DOCUMENTS 3,106,625 A * 10/1963 Marley ..... H01H 51/10 335/120
3,146,327 A * 8/1964 Ohki ..... H01H 51/287 200/241
3,517,358 A * 6/1970 Davis ..... H01H 51/06 335/192

(Continued)

FOREIGN PATENT DOCUMENTS

DE 3202580 A1 8/1983
EP 1315189 A2 5/2003

(Continued)

OTHER PUBLICATIONS

European Search Report, Appl No. 18200458.0, dated Apr. 8, 2019, 8 pages.

(Continued)

*Primary Examiner* — Shawki S Ismail
*Assistant Examiner* — Lisa N Homza
(74) *Attorney, Agent, or Firm* — Barley Snyder

(57) ABSTRACT

A stationary contact spring for a relay includes a base section fixed in a housing of the relay, a contact area opposite the base section adapted to perform an electric switching with a contact force, a spring section extending between the base section and the contact area, and an abutting latch abutting the housing with a biasing force directed against the contact force.

21 Claims, 3 Drawing Sheets

(56) References Cited

U.S. PATENT DOCUMENTS

| | | | | | |
|---|---|---|---|---|---|
| 3,689,856 | A * | 9/1972 | Lambert | H01H 1/28 | 335/133 |
| 3,787,789 | A * | 1/1974 | Harris | H01H 50/048 | 335/193 |
| 3,885,115 | A * | 5/1975 | Schrotter | H01H 1/26 | 200/245 |
| 4,087,667 | A * | 5/1978 | Heider | H01H 1/26 | 200/245 |
| 4,290,037 | A * | 9/1981 | Inagawa | H01H 50/28 | 335/128 |
| 4,307,361 | A * | 12/1981 | Grunert | H01H 51/10 | 335/167 |
| 4,323,945 | A * | 4/1982 | Sauer | H01H 50/56 | 335/192 |
| 4,342,019 | A * | 7/1982 | Schedele | H01H 50/28 | 335/128 |
| 2012/0092100 | A1* | 4/2012 | Choi | H01H 51/065 | 335/192 |
| 2013/0082806 | A1* | 4/2013 | Moriyama | H01H 50/026 | 335/192 |
| 2014/0232493 | A1* | 8/2014 | Lee | H01H 50/18 | 335/192 |

FOREIGN PATENT DOCUMENTS

| | | | |
|---|---|---|---|
| JP | 2000323001 | A | 11/2000 |
| JP | 2006012565 | A | 1/2006 |

OTHER PUBLICATIONS

Abstract of DE 3202580, dated Aug. 4, 1983, 1 page.
Abstract of EP 1315189, dated May 28, 2003, 2 pages.
Abstract of JP2000323001, dated Nov. 24, 2000, 1 page.

* cited by examiner

KIT AND METHOD FOR THE ASSEMBLY OF AT LEAST TWO VARIANTS OF A RELAY AND CONTACT SPRING FOR A RELAY

CROSS-REFERENCE TO RELATED APPLICATION

This application claims the benefit of the filing date under 35 U.S.C. § 119(a)-(d) of European Patent Application No. 18200458.0, filed on Oct. 15, 2018.

FIELD OF THE INVENTION

The present invention relates to a relay and, more particularly, to a stationary contact spring of a relay.

BACKGROUND

Relays are widely used in home appliances, automation systems, communication devices, remote control devices, and automobiles. The function of a relay can vary for each application, whereby the applications usually require small low-cost relays with a low power consumption. Automobile relays, for example used for switching high power lamp loads, have various size and weight constraints. For different applications the requirements vary. Therefore, a wide variety of different components must be provided in order to assemble a relay according to the different application requirements. This leads to the production of specific components for each application, increasing production and storage costs.

SUMMARY

A stationary contact spring for a relay includes a base section fixed in a housing of the relay, a contact area opposite the base section adapted to perform an electric switching with a contact force, a spring section extending between the base section and the contact area, and an abutting latch abutting the housing with a biasing force directed against the contact force.

BRIEF DESCRIPTION OF THE DRAWINGS

The invention will now be described by way of example with reference to the accompanying Figures, of which.

DETAILED DESCRIPTION OF THE EMBODIMENT(S)

Figure 2:
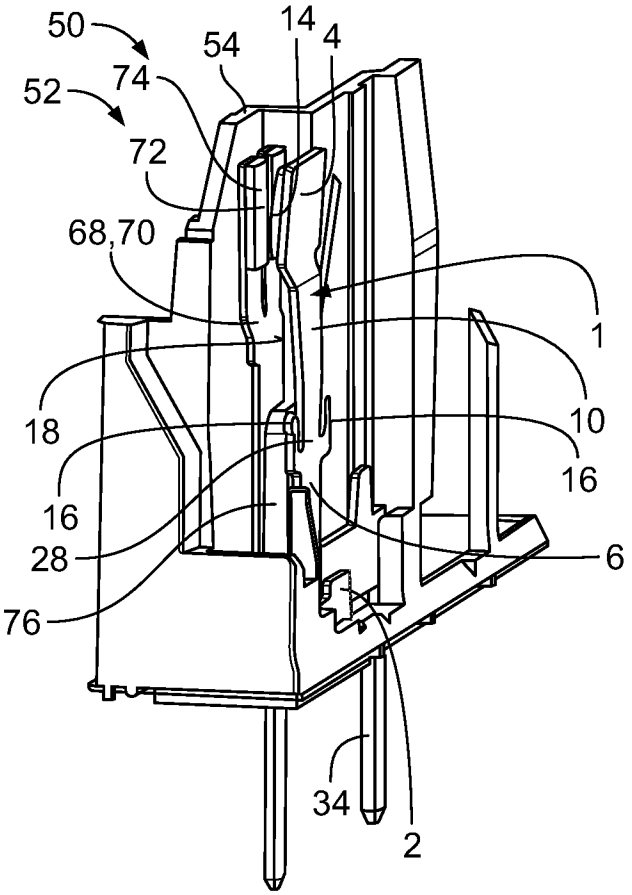
FIG. 2 is a perspective view of an assembled relay.

Embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the disclosure will convey the concept of the invention to those skilled in the art. According to the description of the various aspects and embodiments, elements shown in the drawings can be omitted if the technical effects of these elements are not needed for a particular application, and vice versa.

Figure 1:
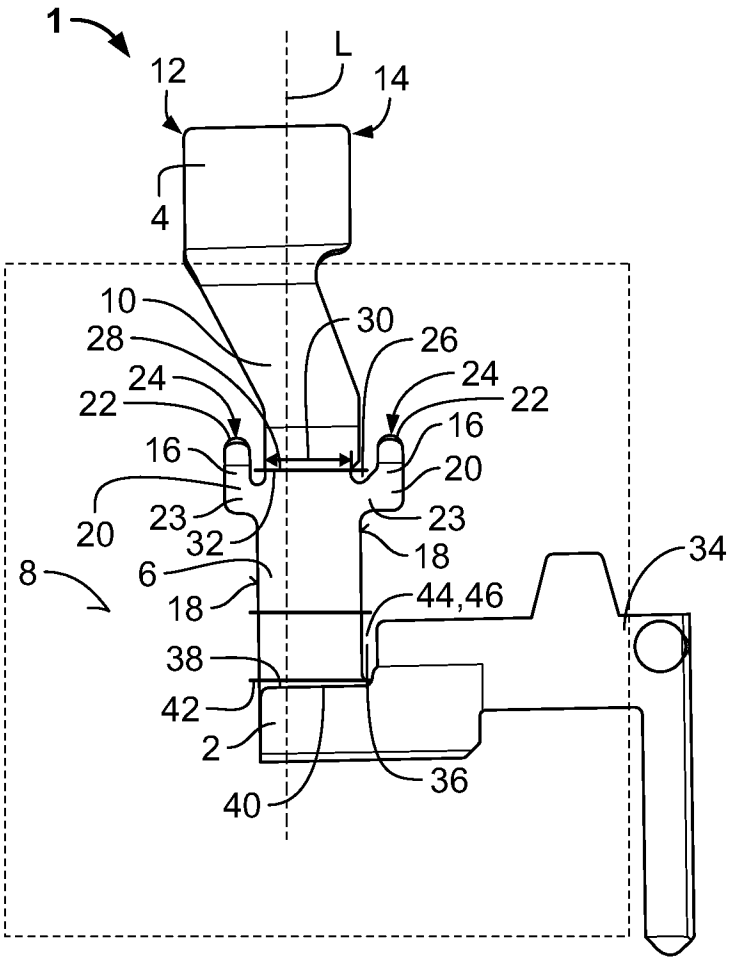
FIG. 1 is a perspective view of a stationary contact spring according to an embodiment.

A stationary contact spring 1 according to an embodiment is shown in FIG. 1. The contact spring 1 has a base section 2 for fixing the contact spring 1 in a housing, a contact area 4 opposite the base section 2 for accomplishing the electric switching, and a spring section 6 extending along a longitudinal axis L from the base section 2 to the contact area 4.

The spring section 6, as shown in FIG. 1, is arranged in a plane 8 and the contact area 4 is distanced from the plane 8 so that the contact spring 1 is bent away from the plane 8 in a transition section 10 between spring section 6 and contact area 4. The contact area 4 has a contact surface 12 with a convexly shaped contacting pad 14 for contacting a complementary contact pad of a switching contact. The contacting pad 14, however, may comprise any other form in other embodiments; the contacting pad 14 may have a planar shape. The contact area 4 is titled toward the plane 8, so that the contacting pad 14 is arranged essentially parallel to the complementary contacting pad when making the contact. Therefore, a relative motion between the contacting pads during over travel can be reduced.

The contact spring 1, as shown in FIG. 1, has a pair of abutting latches 16 each protruding from an opposite lateral side 18 of the spring section 6. The abutting latches 16 are cantilevered and have an essentially L-shape, so that the abutting latches 16 each have a first arm 20 which extends along a direction parallel to the longitudinal axis L with a tip 22 and a second arm 23 that is connected to the spring section 6 and extends perpendicular to the longitudinal axis L. The tip 22 may be distanced from the plane 8, so that the abutting latch 16 is at least partially bent away from the plane 8. The tip 22 has an abutting surface 24 for abutting a housing of the relay. The abutting surface 24 has a profile (not shown) for further increasing the biasing force between the contact spring 1 and the housing. In an embodiment, the abutting surface 24 is parallel to the housing so that the at least one abutting latch 16 abuts the housing with a flat surface.

On a side of the spring section 6, as shown in FIG. 1, a circular shaped notch 26 is provided at the connection between the abutting latch 16 and the spring section 6, defining a first bending zone 28 with a smaller width 30 than its immediate surroundings. The position at which the contact spring 1 is bent around an axis of rotation 32 and consequently also the length of the lever arm extending from the contact area 4 and the first bending zone 28 can be well defined. This can facilitate the design of a relay, in particular to design the relay so that the contact spring 1 and the switch contact have a similar motion path during over travel, further preventing relative motion between the contacting pads.

The base section 2 is reinforced. A material thickness of the base section 2 is higher than a material thickness of the spring section 6. In the shown embodiment, the reinforcement is realized by folding the base section 2 at about 180° so that the base section 2 is double layered. The base section 2 extends perpendicular to the longitudinal axis L beyond one lateral side 18 of the spring section 6 and has an L-shaped connection pin 34. A gap 36 is provided between the lateral side 18 of the spring section 6 and the base section 2, in particular the connection pin 34.

As shown in FIG. 1, a border 38 between the reinforced base section 2 and the spring section 6 defines a second bending zone 40 with an axis of rotation 42 arranged perpendicular to the longitudinal axis L. As long as the contact force is smaller than the biasing force, the contact spring 1 is bendable and/or bent around the axis of rotation 32 of the first bending zone 28. Once the contact force exceeds the biasing force, the contact spring 1 further bends around the axis of rotation 42 at the second bending zone 40.

A cleavage 44 or cut out 46 of the reinforced base section 2, shown in FIG. 1, can be provided in order to position the border 38 and therefore the second bending zone 40 further away from the contact area 4. This leads to a larger lever arm. Thus, a lower force is necessary in order to deflect the contact spring at the second bending zone 40.

Figure 3:
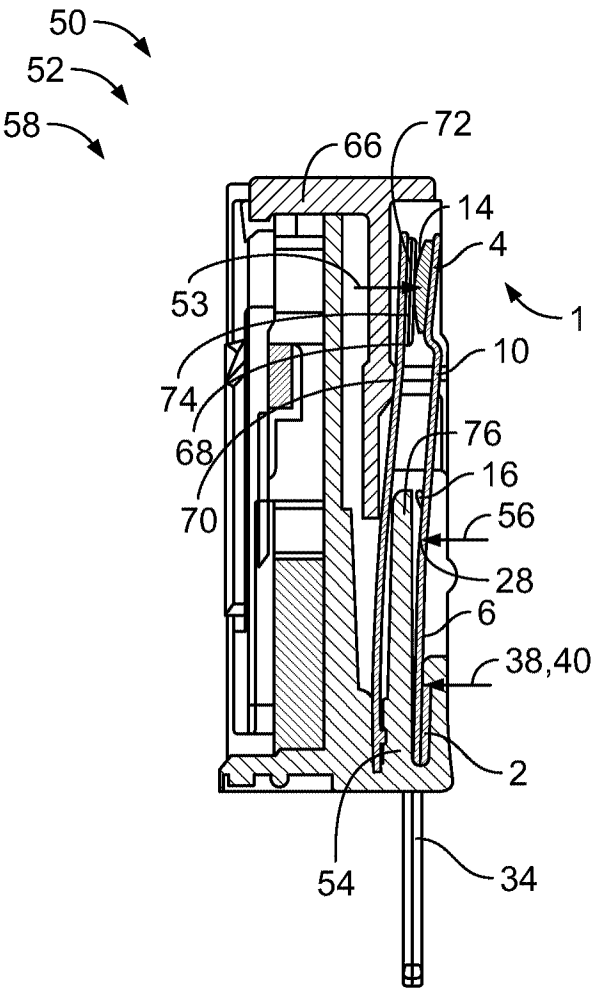
FIG. 3 is a sectional side view of the relay according to a first variant.
Figure 5:
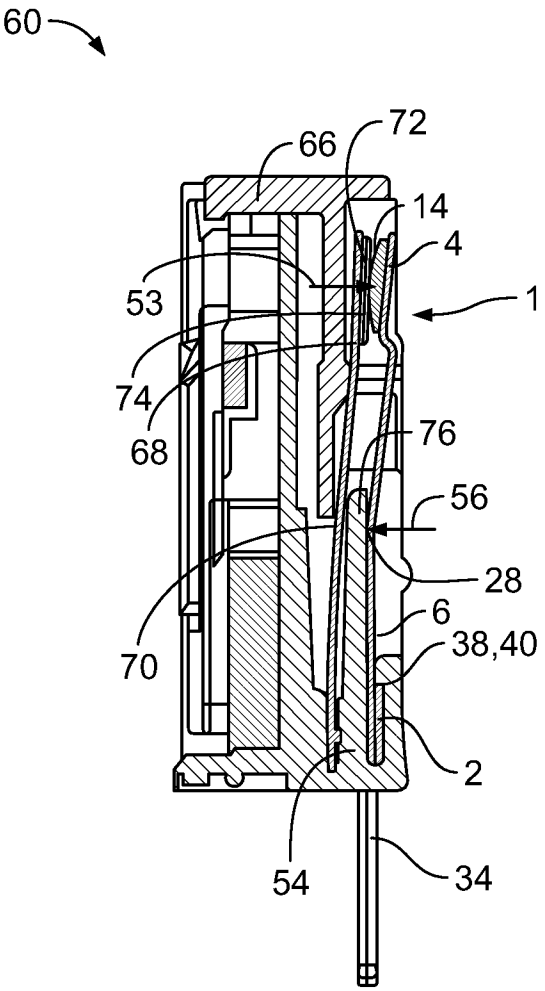
FIG. 5 is a sectional side view of the relay according to a second variant.

The contact spring 1 may be a component of a kit 50. An assembled relay 52 from the kit 50 is shown in FIGS. 2, 3, and 5. The kit 50 is for the assembly of at least two variants of a relay 52, each variant having a different switching characteristic and a same predetermined contact force 53.

The kit 50, as shown in FIGS. 2, 3, and 5, has at least two structurally identical stationary contact springs 1 and at least two housings 54. The stationary contact spring 1 is mounted abutting the housing 54 with a biasing force 56 that is directed against the contact force 53. In FIG. 3, a first variant of a relay 58 is shown wherein the biasing force 56 is lower than the contact force 53. In FIG. 5, a second variant of the relay 60 is shown, wherein the biasing force 56 is higher than the contact force 53.

The relay 58, as shown in FIGS. 3 and 5, has an actuator 66, which may be electrically insulating between the armature and a movable switching contact 68. The switching contact 68 is formed by a spring 70 and a contact area 72 with a contacting pad 74. The contact area 72 is split along the longitudinal axis L for further decreasing any bouncing movements during contact switching. The stationary contact spring 1 is mounted in the housing 54 arranged opposite to the switching contact 68. Initially the contact spring 1 and the switching contact 68 are distant from one another, whereby the respective contacting pads 14, 74 face each other; the stationary contact spring 1 can normally be an open contact spring. The movement of the armature towards the yoke is used to push the actuator 66 against the contact area 72 on the side opposite the contacting pad 74 toward the stationary contact spring 1, closing the initial gap between the contacting pads 14, 74.

The actuator 66 travels a predefined distance after contact closure, resulting in a deflection of the stationary contact spring 1 together with the movement of the switching contact 68, which is referred to as over travel. The over travel ensures the build-up of the specified contact force 53 of the closed contact, which is necessary to achieve low contact resistances to keep the heating of the contacting pads 14, 74 at a minimum. Furthermore, it also compensates a loss of contact material caused by contact wear, which may occur due to an electric arc during making or breaking of the contact.

The housing 54 is insulating and, as shown in FIGS. 2, 3, and 5, has an abutting platform 76 arranged between the switching contact 68 and the stationary contact spring 1. The stationary contact spring 1 abuts the abutting platform 76 with its abutting latches 16, so that the abutting surfaces 24 are pressed against the platform 76 with the biasing force 56. The abutting latches 16 can be adjusted in order to set the biasing force 56. For example, the contact spring 1 is adjustable between the first variant 58 and the second variant 60 such that the abutting latches 16 in the second variant 60 can at least partially be further bent away from the plane 8 towards the abutting platform 76, in order to increase the biasing force 56. The stationary contact spring 1 can be mounted in the housing 54 at a higher angle towards the abutting platform 76 of the housing 54 in the second variant 60 than in the first variant 58. Thereby, the biasing force 56 can also be influenced by the mounting of the stationary contact spring 1 in the housing 54, without the need of adjusting the abutting latches 16.

In the first variant 58, shown in FIG. 3, the biasing force 56 is lower than the contact force 53 at the end of a switching cycle. Therefore, the contact spring 1 is first bent around the axis of rotation 32 of the first bending zone 28 until the contact force 53 and the biasing force 56 are in an equilibrium. Thereafter, the contact spring 1 is bent around the axis of rotation 42 at the second bending zone 40 causing the contact spring 1 and in particular the abutting latches 16 to be deflected away from the abutting platform 76.

Figure 4:
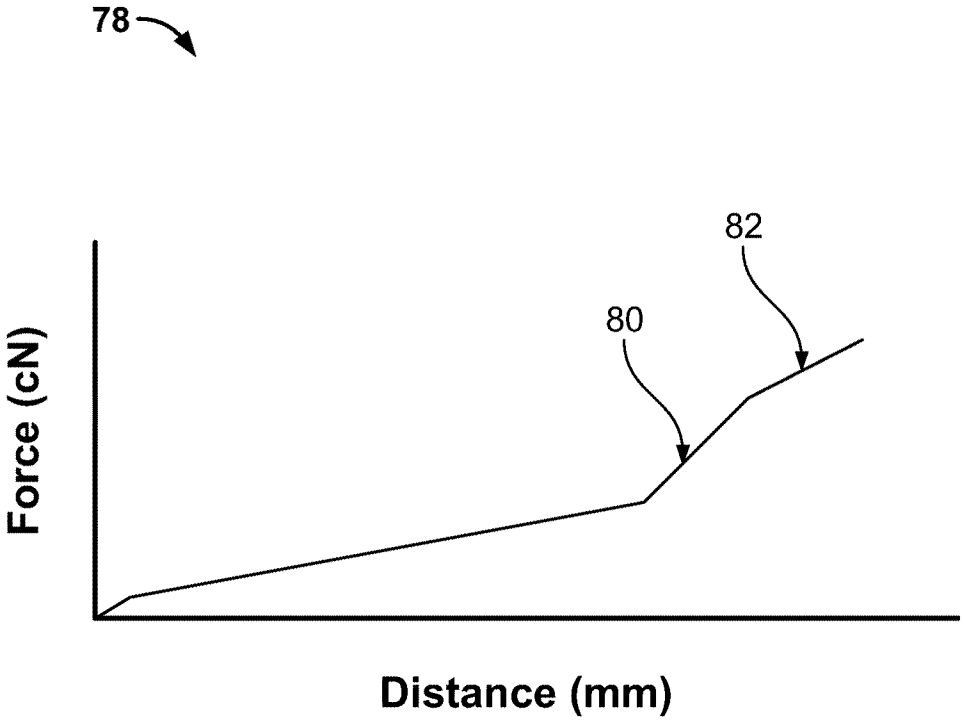
FIG. 4 is a graph of a spring characteristic of the first variant.

Spring characteristics 78 of the contact system in the first variant 58 are shown in a graph in FIG. 4. The diagram graph the relation between the force exerted on the contact system comprising the contact spring 1 and switching contact 68 and the distance the contact system is deflected. The spring characteristics 78 exhibit two distinctive points at which the slope of the spring characteristics 78 changes. Until the equilibrium between contact force 53 and biasing force 56 is achieved, the lever arm between contact area 4 and first bending zone 28, more specifically the contact point at which the switching contact 68 contacts the contact area 4 and the first bending zone 28, defines the spring characteristics. This lever arm is rather short and thus the contact spring 1 is rather rigid and the force necessary to deflect the contact spring 1 is rather high. This is represented by a steep slope 80 in FIG. 4. However, once the contact force 53 exceeds the biasing force 56, the contact spring 1 is further bent around the axis of rotation 42 at the second bending zone 40. Therefore, the lever arm between the contact area and the second bending zone 40, more specifically the contact point at which the switching contact 68 contacts the contact area 4 and the second bending zone 40, defines the spring characteristics. Here the lever arm is rather large resulting in a flat slope 82 of the spring characteristics since the additional force needed to further deflect the contact spring 1 is rather low.

The first variant 58 permits a low drive force of about 100 mW in order to complete the switching cycle, reducing the power consumption of the relay. The first variant 58 may thus be applied in particular for low inrush relay applications, for example for resistive loads. The first variant 58 may have an inrush capacity of about 15-20 A.

Figure 6:
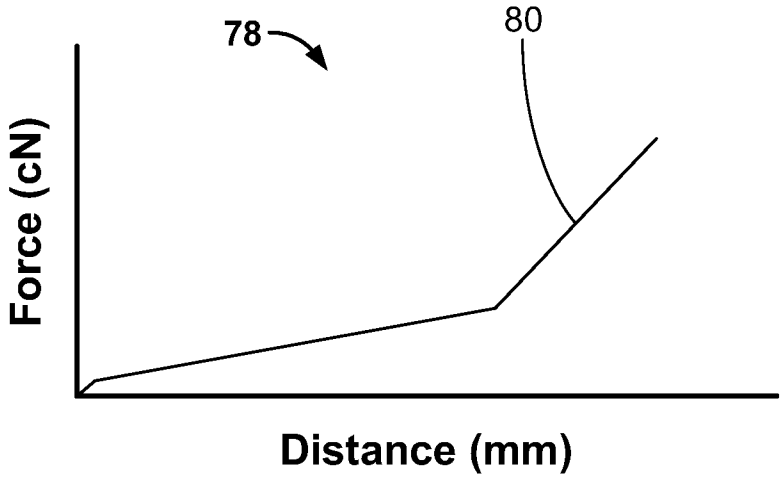
FIG. 6 is a graph of a spring characteristic of the second variant.

In the second variant 60, shown in FIG. 5, the biasing force 56 is always higher than the contact force 53. Therefore, the contact spring 1 is only bent around the axis of rotation 32 at the first bending zone 28, as can be seen by the steep slope in the schematic diagram displayed in FIG. 6. Due to the short lever arm, the contact spring 1 exhibits rigid spring characteristics, which can reduce contact bouncing. Therefore, the second variant 60 may in particular be applicable for high inrush loads for example to switch high power lamps. The second variant 60 may have an inrush capacity of about 45 A.

The at least one abutting latch 16 may at least partially be plastically deformed further toward the housing 54 in the second variant 60 in comparison to the first variant 58 in order to adjust the biasing force 56 with which the stationary contact spring 1 abuts the housing 54. Thus, the contact spring 1 may easily be adjusted according to different requirements of the relay application. The abutting latch 16 may be arranged in a plane with the spring section 6 in the first variant 58 and be at least partially bent away from said plane in the second variant 60. Alternatively, the at least one abutting latch 16 may at least partially be bent away from the plane in the first variant 58 and may be further bent away from the plane in the second variant 60 towards the housing 54, which the at least one abutting latch 16 abuts with the biasing force 56. The contact spring 1, in particular the at least one abutting latch 16 may be stronger elastically formed towards the housing 54 and/or away from the plane 8 in the second variant 60 in comparison to the first variant 58.

Each abutting latch 16 can be adjusted independently from one another, giving the user more freedom in designing the relay. For example the biasing force 56 with which the abutting latches 16 abut the housing can be equal for each abutting latch 16. This leads to a linear traveling path of the contact spring 1 when the contact force 53 is higher than the biasing force 56. If the biasing force 56 is set differently, the spring section 6 torques along the longitudinal axis once the contact force 53 is higher than the biasing force 56. Furthermore, the abutting latches 16 may be adjusted, depending on the abutting surface of the housing.

The stationary contact spring 1 may in particular be a stamped part. The contact spring 1 may comprise a kink at the first bending zone 28 and/or second bending zone 40, in order to further establish the position of the first bending zone 28 and/or second bending zone 40. The at least two contact springs 1 in the variants 58, 60 may be identically structured meaning that they can have the same dimensions and form.

By having an identically structured stationary contact spring 1 mounted in different variants 58, 60 of a relay, the stationary contact spring 1 can be standardized. Therefore, the amount of different stationary contact springs 1 that have to be produced can be minimized. The contact spring 1 can be mounted with a different biasing force in the housing 54 of the relay according to the relays application requirements.

What is claimed is:

1. A relay, comprising:

a housing; and a stationary contact spring having a base section fixed in the housing, a contact area opposite the base section, and a spring section extending between the base section and the contact area, the stationary contact spring abuts the housing with a biasing force directed against a contact force, the biasing force in a first variant of the relay is lower than the contact force and the biasing force in a second variant of the relay is higher than the contact force, the stationary contact spring has an abutting latch abutting the housing with the biasing force, a free end of the abutting latch is plastically deformable into a plurality of positions relative to the spring section for altering the biasing force between the contact spring and the housing.

2. The relay of claim 1, wherein the stationary contact spring is identically structured in the first variant and in the second variant.

3. The relay of claim 2, wherein the abutting latch is at least partially plastically deformed further toward the housing in the second variant than in the first variant.

4. The relay of claim 1, wherein the second variant is a high inrush relay and has an inrush capacity of about 45 A.

5. The relay of claim 1, wherein the first variant is a low inrush relay and has an inrush capacity of about 15-20 A.

6. The relay of claim 1 wherein the free end of the abutting latch defines an abutting surface bent away from a plane in which the spring section is arranged.

7. The relay of claim 6, wherein the abutting surface is bent toward the housing in the second variant.

8. A stationary contact spring for a relay, comprising:

a base section fixed in a housing of the relay;

a contact area opposite the base section adapted to perform an electric switching with a contact force;

a spring section extending between the base section and the contact area; and an abutting latch abutting the housing with a biasing force directed against the contact force, the abutting latch is integrally formed with the spring section and extends from the spring section, the abutting latch has a free tip with an abutting surface bent away from a plane in which the spring section is arranged.

9. The stationary contact spring of claim 8, further comprising a pair of abutting latches each protruding from a lateral side of the spring section.

10. The stationary contact spring of claim 8, wherein the abutting latch is L-shaped and cantilevered.

11. The stationary contact spring of claim 8, wherein a free end of the abutting latch is plastically deformable into a plurality of positions relative to the spring section.

12. A relay, comprising:

a housing; and a stationary contact spring having a base section fixed in the housing, a contact area opposite the base section, and a spring section extending between the base section and the contact area, the stationary contact spring abuts the housing with a biasing force directed against a contact force, the biasing force in a first variant of the relay is lower than the contact force and the biasing force in a second variant of the relay is higher than the contact force, the first variant is a low inrush relay and has an inrush capacity of about 15-20 A and/or the second variant is a high inrush relay and has an inrush capacity of about 45 A.

13. A stationary contact spring for a relay, comprising:

a base section fixed in a housing of the relay;

a contact area opposite the base section adapted to perform an electric switching with a contact force;

a spring section extending between the base section and the contact area;

an abutting latch abutting the housing with a biasing force directed against the contact force; and a first bending zone having a smaller width in comparison to an area immediately surrounding the first bending zone.

14. The stationary contact spring of claim 13, wherein the first bending zone is formed by a notch at the abutting latch.

15. The stationary contact spring of claim 13, wherein the base section is reinforced.

16. The stationary contact spring of claim 15, wherein a second bending zone is formed by a border between the spring section and the base section.

17. The stationary contact spring of claim 16, wherein the first bending zone and/or the second bending zone is defined by a kink.

18. A stationary contact spring for a relay, comprising:

a base section fixed in a housing of the relay;

a contact area opposite the base section adapted to perform an electric switching with a contact force;

a spring section extending between the base section and the contact area, the base section extends beyond a lateral side of the spring section and a gap is disposed between the lateral side of the spring section and the base section; and an abutting latch abutting the housing with a biasing force directed against the contact force.

19. A stationary contact spring for a relay, comprising:

a base section fixed in a housing of the relay;

a contact area opposite the base section adapted to perform an electric switching with a contact force;

a spring section extending between the base section and the contact area; and a pair of abutting latches abutting the housing with a biasing force directed against the contact force, the abutting latches are integrally formed with the spring section and extend from the spring section, the abutting latches each protrude from a lateral side of the spring section.

20. A stationary contact spring for a relay, comprising:

a base section fixed in a housing of the relay;

a contact area opposite the base section adapted to perform an electric switching with a contact force;

a spring section extending between the base section and the contact area; and an abutting latch abutting the housing with a biasing force directed against the contact force, the abutting latch is integrally formed with the spring section and extends from the spring section, the abutting latch is L-shaped and cantilevered.

21. A stationary contact spring for a relay, comprising:

a base section fixed in a housing of the relay;

a contact area opposite the base section adapted to perform an electric switching with a contact force;

a spring section extending between the base section and the contact area; and an abutting latch abutting the housing with a biasing force directed against the contact force, the abutting latch is integrally formed with the spring section and extends from the spring section, a free end of the abutting latch is plastically deformable into a plurality of positions relative to the spring section.

* * * * *